US010125795B2

(12) United States Patent
Chen

(10) Patent No.: US 10,125,795 B2
(45) Date of Patent: Nov. 13, 2018

(54) ADJUSTABLE FAN DAMPING APPARATUS FOR EXERCISER

(71) Applicant: Ya-Chi Chen, New Taipei (TW)

(72) Inventor: Ya-Chi Chen, New Taipei (TW)

( * ) Notice: Subject to any disclaimer, the term of this patent is extended or adjusted under 35 U.S.C. 154(b) by 258 days.

(21) Appl. No.: 15/353,218

(22) Filed: Nov. 16, 2016

(65) Prior Publication Data

US 2018/0135655 A1 May 17, 2018

(51) Int. Cl.

| | |
|---|---|
| ***F04D 29/66*** | (2006.01) |
| ***F04D 29/42*** | (2006.01) |
| ***A63B 21/22*** | (2006.01) |
| ***A63B 22/00*** | (2006.01) |
| ***A63B 22/06*** | (2006.01) |
| ***F04D 27/00*** | (2006.01) |
| ***F04D 29/46*** | (2006.01) |

(52) U.S. Cl.

CPC ..... *F04D 29/668* (2013.01); *A63B 21/225* (2013.01); *A63B 22/0076* (2013.01); *A63B 22/0605* (2013.01); *F04D 27/002* (2013.01); *F04D 29/4213* (2013.01); *F04D 29/4226* (2013.01); *F04D 29/462* (2013.01)

(58) Field of Classification Search

None

See application file for complete search history.

(56) References Cited

U.S. PATENT DOCUMENTS

| | | | | |
|---|---|---|---|---|
| 3,580,694 | A * | 5/1971 | Andersen | F04D 29/364 416/136 |
| 3,984,194 | A * | 10/1976 | Fermer | F04D 29/34 416/135 |
| 7,399,161 | B2 * | 7/2008 | Kao | F04D 29/30 416/187 |
| 9,068,573 | B2 * | 6/2015 | Kuo | F04D 25/0613 |
| 9,689,264 | B2 * | 6/2017 | Cocks | F01D 5/141 |
| 2012/0224951 | A1 * | 9/2012 | Degner | F04D 25/062 415/174.1 |

* cited by examiner

*Primary Examiner* — Stephen R Crow

(74) *Attorney, Agent, or Firm* — Egbert Law Offices, PLLC

(57) ABSTRACT

An adjustable fan damping apparatus for exerciser includes a casing having an annular chamber defined therein and an annular intake structure is disposed to an inner side of the annular chamber. A centrifugal impeller is rotatably received in the annular chamber. Multiple adjust blades is pivotally mounted onto the annular intake structure and surrounds the annular intake structure, wherein each adjust blade has two pivots longitudinally extending from two opposite ends of the adjust blade and a driven element extending from one side of then adjust blade where the two pivots extends. A drive device is connected to the driven element of each of the multiple adjust blades. The drive device includes a driving element is rotatably coupled with the driven element of each of the multiple adjust blades for simultaneously driving the multiple adjust blades in a same angle relative to the annular intake structure.

3 Claims, 5 Drawing Sheets

ADJUSTABLE FAN DAMPING APPARATUS FOR EXERCISER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a fan damping apparatus, and more particularly to an adjustable fan damping apparatus for exerciser.

2. Description of Related Art Including Information Disclosed Under 37 CFR 1.97 and 37 CFR 1.98

As to the structural design of an exerciser, a suitable damping device is necessary for promoting an exercising effect.

As are well known, damping devices are divided into two types including a magnetic damping device and a fan damping device, wherein the magnetic damping device adjusts the damping value by changing magnetic field thereof.

The blades of the conventional fan damping device are fixed such that the intake rate of the conventional fan damping device. Accordingly, the damping provided by the conventional fan damping device cannot be adjusted. As a result, the conventional apparatus cannot satisfy the multivariate requirement of the user.

The present invention has arisen to mitigate and/or obviate the disadvantages of the conventional fan damping device of exerciser.

BRIEF SUMMARY OF THE INVENTION

The main objective of the present invention is to provide an improved adjustable fan damping apparatus for exerciser.

To achieve the objective, the adjustable fan damping apparatus in accordance with the present invention includes a casing having an annular chamber defined therein and an annular intake structure is disposed to an inner side of the annular chamber. A centrifugal impeller is rotatably received in the annular chamber. Multiple adjust blades is pivotally mounted onto the annular intake structure and surrounds the annular intake structure, wherein each adjust blade has two pivots longitudinally extending from two opposite ends of the adjust blade and a driven element extending from one side of then adjust blade where the two pivots extends. A drive device is connected to the driven element of each of the multiple adjust blades. The drive device includes a driving element is rotatably coupled with the driven element of each of the multiple adjust blades for simultaneously driving the multiple adjust blades in a same angle relative to the annular intake structure.

Further benefits and advantages of the present invention will become apparent after a careful reading of the detailed description with appropriate reference to the accompanying drawings.

DETAILED DESCRIPTION OF THE INVENTION

Figure 1:
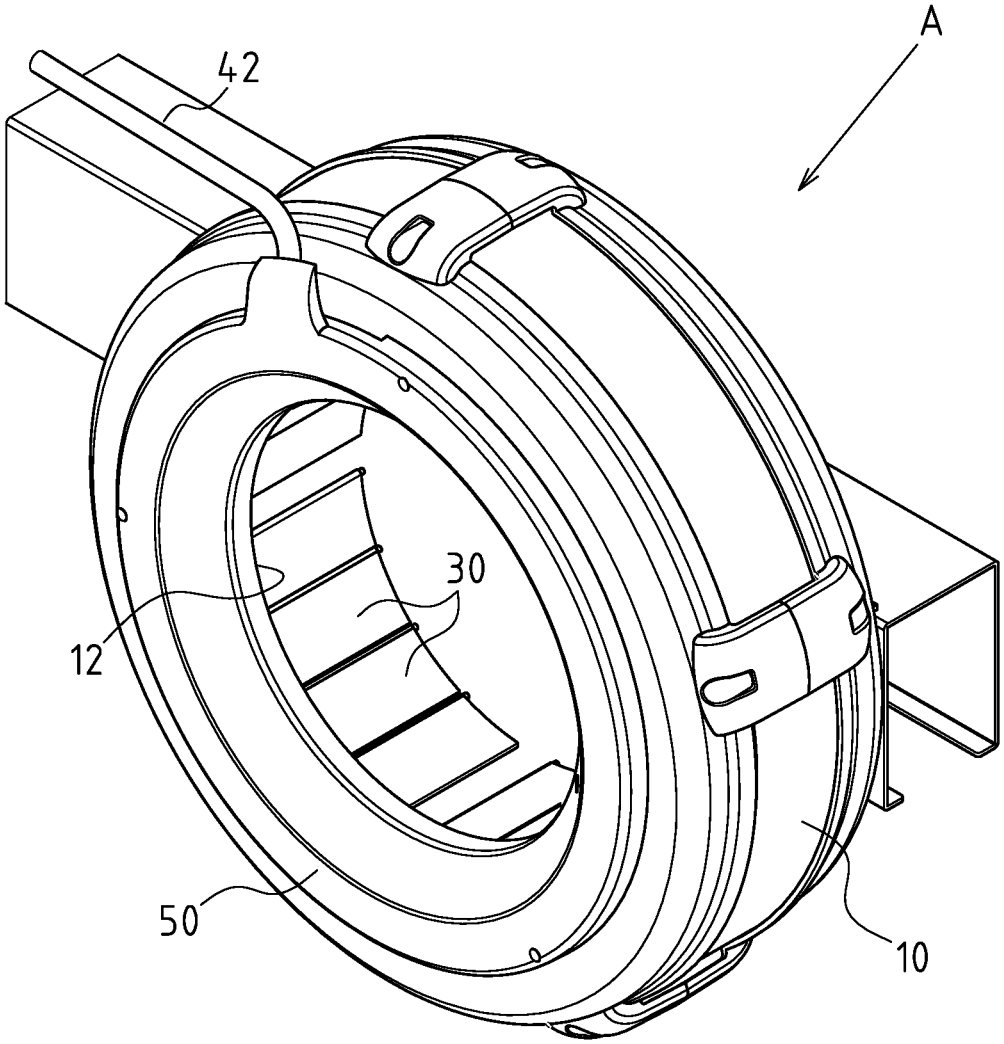
FIG. 1 is a perspective view of an adjustable fan damping apparatus for exerciser in accordance with the present invention.

Referring to the drawings and initially to FIGS. 1-5, an adjustable fan damping apparatus A for exerciser in accordance with the present invention comprises a casing 10 including an annular chamber 11 defined therein and an annular intake structure 12 is disposed to an inner side of the annular chamber 11. A centrifugal impeller 20 is rotatably received in the annular chamber 11 in the casing 10. Multiple adjust blades 30 is pivotally mounted onto the annular intake structure 12 of the casing 10 and surrounds the annular intake structure 12, wherein each adjust blade 30 has two pivots 31 longitudinally extending from two opposite ends of the adjust blade 30 and a driven element 32 extending from one side of then adjust blade 30 where the two pivots 31 extends. The two pivots 31 co-axially correspond to each other. A drive device 40 is connected to the driven element 32 of each of the multiple adjust blades 30. The drive device 40 includes a driving element 413 is rotatably coupled with the driven element 32 of each of the multiple adjust blades 30 for simultaneously driving the multiple adjust blades 30 in a same angle relative to the annular intake structure 12.

Figure 2:
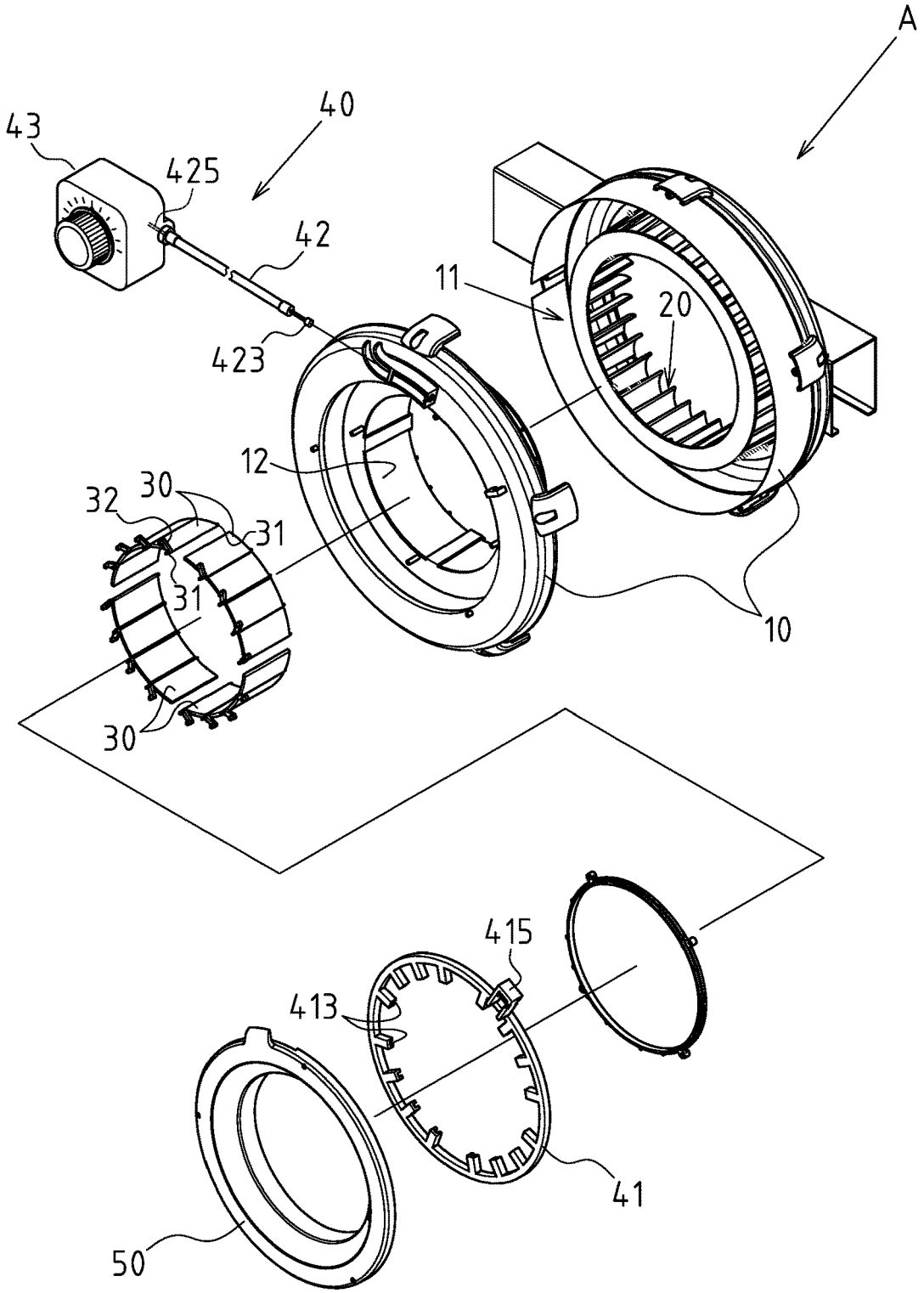
FIG. 2 is an exploded perspective view of the adjustable fan damping apparatus in FIG. 1.
Figure 3:
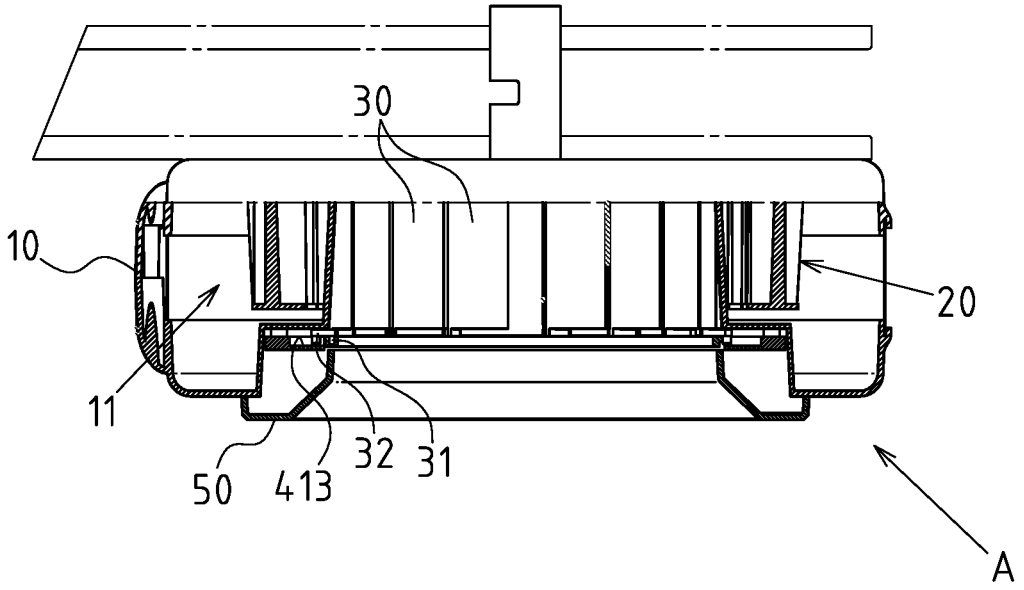
FIG. 3 is a partially cross-sectional view of the adjustable fan damping apparatus in FIG. 1.
Figure 4:
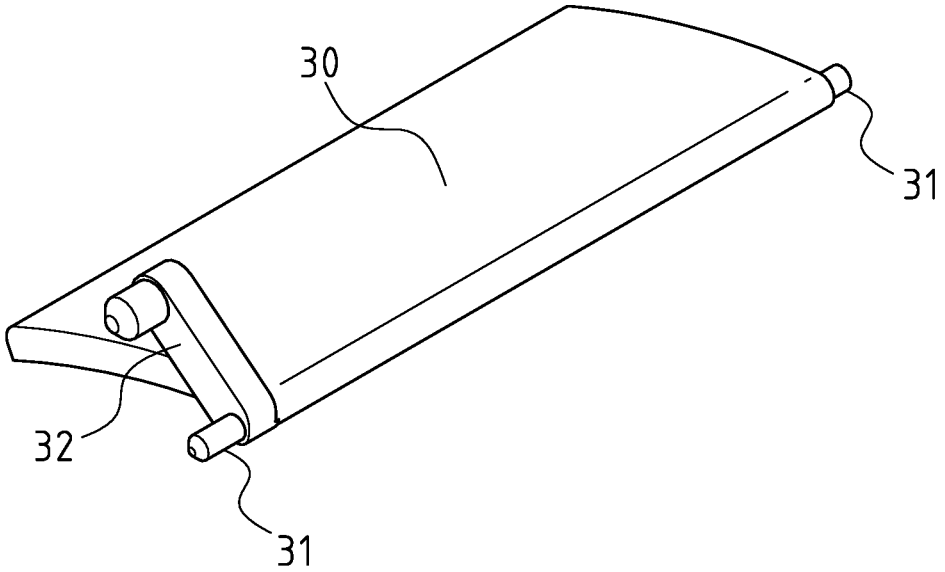
FIG. 4 is a perspective view of an adjust blade of the adjustable fan damping apparatus in accordance with the present invention.

With reference to FIG. 2, the drive device 40 includes a ring 41, a cable 42 and a controller 43, wherein the ring 41 is rotatably received in the casing 10 for simultaneously driving the multiple adjust blades 30 in a same angle relative to the annular intake structure 12. In the preferred embodiment of the present invention, the driving element 413 includes multiple concave structures defined in the ring 41, wherein a free end of each of the driven element 32 is received in a corresponding one of the multiple concave structures such that the ring 41 simultaneously drives the adjust blades 30. The ring 41 has a port 415 formed thereon, wherein the cable 42 has a first end 423 connected to the port 415 and a second end 425 connected to the controller 42 such that the moving angle of each of the adjust blades 30 is simultaneously adjusted when the controller 43 is rotated and pulls the cable 42.

With reference to FIGS. 1 and 2, the casing 10 further includes a housing 50 mounted thereon for covering the ring 41.

Figure 5:
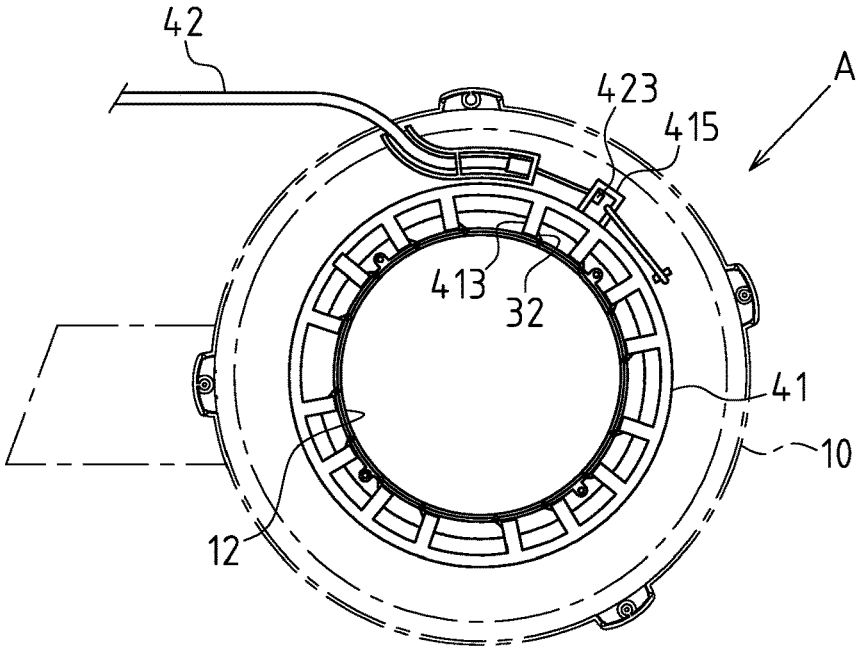
FIG. 5 is a first operational view of the adjustable fan damping apparatus in accordance with the present invention.
Figure 6:
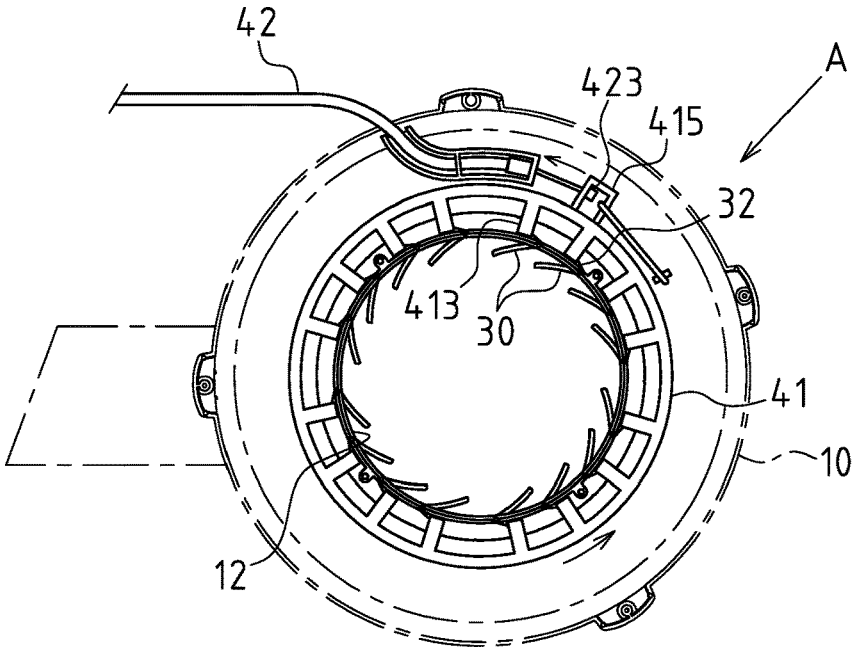
FIG. 6 is a first operational view of the adjustable fan damping apparatus in accordance with the present invention.

With reference to FIGS. 1, 2 and 5, the intake rate of the annular intake structure 12 is minimum and the rotating damping of the centrifugal impeller 20 is maximum when the adjust blades 30 abut the annular intake structure. With reference to FIG. 6, when adjusting the intake rate of the annular intake structure 12, the operator rotates the controller 43 of the drive device 40 for rotating the ring 41 and adjusting the angle of each of the adjust blade 30 relative to the annular intake structure via the cable 42, and the damping provided by the adjustable fan damping apparatus A is adjusted.

Figure 7:
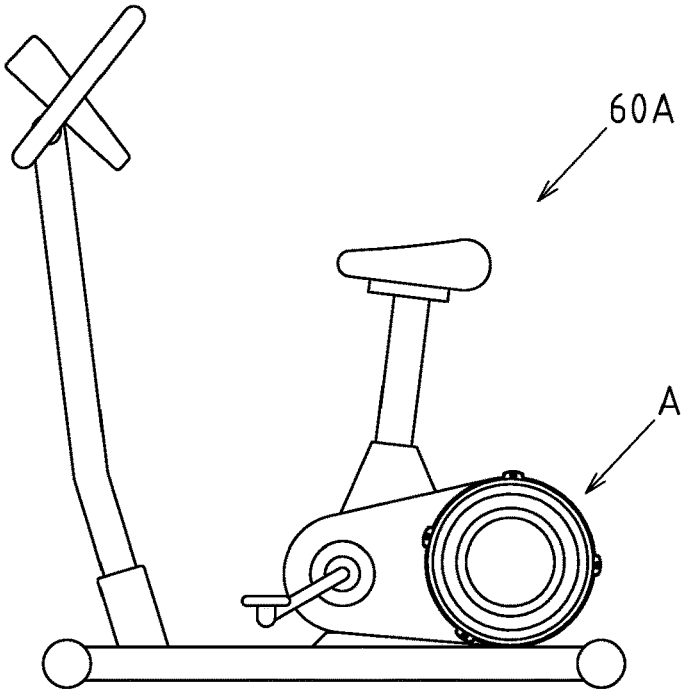
FIG. 7 is a first schematic view of the adjustable fan damping apparatus in accordance with the present invention.
Figure 8:
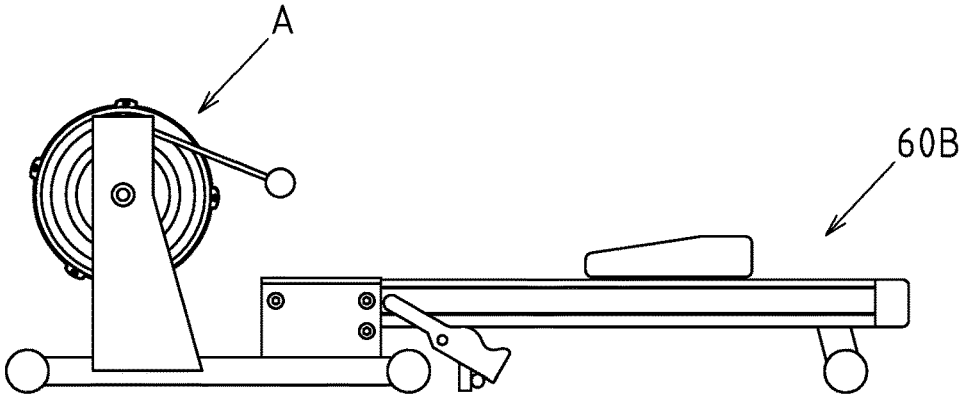
FIG. 8 is a second schematic view of the adjustable fan damping apparatus in accordance with the present invention.

With reference to FIG. 7, the adjustable fan damping apparatus A in accordance with the present invention is coupled with a bike 60A. With reference to FIG. 8, the adjustable fan damping apparatus A in accordance with the present invention is coupled with a rowing machine 60B.

Although the invention has been explained in relation to its preferred embodiment, it is to be understood that many other possible modifications and variations can be made without departing from the spirit and scope of the invention as hereinafter claimed.

I claim:

1. An adjustable fan damping apparatus for an exercise device, comprising:

a casing including an annular chamber defined therein and an annular intake structure disposed to an inner side of the annular chamber;

a centrifugal impeller rotatably received in the annular chamber in the casing; and multiple adjust blades pivotally mounted onto the annular intake structure of the casing and surrounding the annular intake structure, wherein each adjust blade has two pivots longitudinally extending from two opposite ends of the adjust blade and a driven element extending from one side of the adjust blade where the two pivots extends, the two pivots being co-axial to each other;

a drive device connected to the driven element of each of the multiple adjust blades, the drive device including a driving element rotatably coupled with the driven element of each of the multiple adjust blades for simultaneously driving the multiple adjust blades in a same angle relative to the annular intake structure.

2. The adjustable fan damping apparatus as claimed in claim 1, wherein the drive device includes a ring, a cable and a controller, the ring rotatably received in the casing for simultaneously driving the multiple adjust blades in a same angle relative to the annular intake structure, the driving element including multiple concave structures defined in the ring, wherein a free end of each of the driven element is received in a corresponding one of the multiple concave structures such that the ring simultaneously drives the adjust blades, the ring having a port formed thereon, wherein the cable has a first end connected to the port and a second end connected to the controller such that the moving angle of each of the adjust blades is simultaneously adjusted when the controller is rotated and pulls the cable.

3. The adjustable fan damping apparatus as claimed in claim 2, wherein the casing further includes a housing mounted thereon for covering the ring.

* * * * *